US008586522B2

(12) United States Patent
Busby et al.

(10) Patent No.: US 8,586,522 B2
(45) Date of Patent: Nov. 19, 2013

(54) GLYCOL DILEVULINATES AS COUPLING AGENTS IN CLEANING FORMULATIONS

(75) Inventors: David C. Busby, Midland, MI (US); Molly I. Busby, Midland, MI (US); William Jack Kruper, Jr., Sanford, MI (US); Mark F. Sonnenschein, Midland, MI (US)

(73) Assignee: Dow Global Technologies LLC, Midland, MI (US)

( * ) Notice: Subject to any disclaimer, the term of this patent is extended or adjusted under 35 U.S.C. 154(b) by 0 days.

(21) Appl. No.: 13/600,549

(22) Filed: Aug. 31, 2012

(65) Prior Publication Data

US 2013/0231272 A1 Sep. 5, 2013

Related U.S. Application Data

(60) Provisional application No. 61/530,580, filed on Sep. 2, 2011.

(51) Int. Cl.
*C11D 3/44* (2006.01)

(52) U.S. Cl.
USPC ..... 510/365; 510/174; 510/213; 510/238; 510/251; 510/253; 510/432

(58) Field of Classification Search
USPC ..... 510/174, 213, 238, 251, 253, 365, 432
See application file for complete search history.

(56) References Cited

U.S. PATENT DOCUMENTS

| | | | | |
|---|---|---|---|---|
| 2,581,008 | A | 1/1952 | Emerson et al. | |
| 2,654,723 | A | 10/1953 | Greene | |
| 3,203,964 | A | 8/1965 | Huffman et al. | |
| 4,085,081 | A * | 4/1978 | Heckles et al. | 524/357 |
| 4,511,488 | A | 4/1985 | Matta | |

FOREIGN PATENT DOCUMENTS

| | | | |
|---|---|---|---|
| GB | 423919 | A | 2/1935 |
| GB | 478854 | A | 1/1938 |
| WO | 2007/094922 | A2 | 8/2007 |
| WO | 2010/102203 | A2 | 9/2010 |

* cited by examiner

*Primary Examiner* — Charles Boyer

(57) ABSTRACT

The present invention provides water-based cleaning formulations comprising one or more organic solvents having low solubility in water and an alkylene glycol dilevulinate for coupling the organic solvent with water.

10 Claims, 8 Drawing Sheets

Various Glycol Ethers General Layout

SLS: 1%

Various Glycol Ethers Stability at 25°C

SLS: 1%

Various Glycol Ethers Stability at 40°C

SLS: 1%

Various Glycol Ethers Stability at 5°C

SLS: 1%

Various Glycol Ethers General Layout

Various Glycol Ethers Stability at 25°C

Various Glycol Ethers Stability at 40°C

Various Glycol Ethers Stability at 5°C

Various Dilvulinates and DMP General Layout

Various Dilevulinates and DPM Stability at 25°C

Various Dievulinates and DPM Stability at 40°C

Various Dilevulinates and DPM Stability at 5°C

Various Dilvulinates and DMP General Layout

Various Dilevulinates and DPM Stability at 25°C

Various Dilevulinates and DPM Stability at 40°C

Various Dilevulinates and DPM Stability at 5°C

GLYCOL DILEVULINATES AS COUPLING AGENTS IN CLEANING FORMULATIONS

FIELD OF THE INVENTION

The present invention relates to cleaning formulations comprising water, one or more organic solvents having low solubility in water such as aliphatic hydrocarbons, aromatic hydrocarbons, or other organic compounds, and an alkylene glycol dilevulinate. The alkylene glycol dilevulinates are excellent solvents for coupling the organic solvents with water.

BACKGROUND OF THE INVENTION

Organic solvents are compounds that can be used to dissolve, soften, melt, or extract another compound, such as grease, soil, oil, paint, glue, stains, etc., and, therefore, are commonly used in cleaning formulations. Typical organic solvents include aliphatic hydrocarbons, isoparaffins, aromatic hydrocarbons, chlorinated hydrocarbons, terpenes and d-limonene, among others. Unfortunately, many organic solvents have limited solubility, or practically zero solubility, in water which severely limits the amounts that can be added to water-based cleaning formulations sometimes to the point where their beneficial effects cannot be realized.

Coupling agents are compounds that facilitate dissolution and dispersion of organic solvents, into water-based formulations, in greater amounts than otherwise possible, while the formulations retain their clarity, viscosity and homogeneity. Various coupling agents are known for use in cleaning formulations including propylene glycol, diethylene glycol, glycol ethers, and surfactants, among others. See U.S. Pat. Nos. 4,511,488. However, lower glycol ethers are volatile organic compounds (VOCs) which are environmentally undesirable. Some higher glycol ethers have lesser solubility in water-based systems, which limits their utility as coupling agents.

Esters of levulinic acid are well known and described in the art as plasticizers and solvents. For example, GB423919 describes the production of esters of levulinic acid with modified polyhydric alcohols which are useful as plasticizers for cellulose derivatives in coating applications.

For example, U.S. Pat. No. 2,654,723 describes the preparation of diethylene glycol dilevulinate by heating a mixture of levulinic acid and diethylene glycol, in a solvent such as toluene and in the presence of an acid catalyst.

International Patent Application No. WO 2010/102203 describes the preparation of alkyl levulinates by an acid-catalyzed reaction of furfuryl alcohol with other alcohols including methanol, ethanol, propanol, isopropanol, butanol, and isobutanol.

In U.S. Pat. No. 3,203,964, a process is described for manufacturing levulinic acid esters by heating furfuryl alcohol with another alcohol selected from the group consisting of unsubstituted primary and secondary carbon chain and oxygen-carbon chain aliphatic and carbon ring and oxygen-carbon ring cycloaliphatic alcohols containing from 1 to 10 carbon atoms, in the presence of a an acid catalyst. U.S. Pat. No. 3,203,964 states that the levulinic acid esters are useful as plasticizers or solvents.

International Patent Application Publication No. WO2007/094922 describes the use of ester derivatives of levulinic acid to replace traditional plasticizers and coalescent solvents in polymer compositions, plastics and water-based coatings, thereby to lowering their VOC content.

GB478854 describes the use of lower alkylene glycol dilevulinates (e.g., dilevulinates of propylene glycol, diethylene glycol, ethylene glycol, trimethylene glycol (1,3-propanediol), 1,3-butylene glycol and dimethyl-dimethylol) as suitable high boiling softening agents for cellulosic pellicles. U.S. Pat. No. 2,581,008 discloses the preparation of dilevulinates of mono-, di- and tri-ethoxylated diols and their use as plasticizers for polyvinyl acetals and other polymers.

Furfuryl alcohol and levulinic acid are two of the reactants that can be used to manufacture esters of levulinic acid, e.g., alkylene glycol dilevulinates. They are both inexpensive renewable feedstocks available from biomass. Thus, the use of levulinates as solvents in water-based cleaning formulations would be economically and environmentally beneficial.

A solvent which would facilitate the use of organic solvents having low water solubility in water-based systems, such as aqueous cleaning formulations, would provide significant advantages relative to solvents traditionally used as coupling agents. The present invention provides for the use of alkylene glycol dilevulinates as new alternative coupling agent solvents in water-based formulations.

SUMMARY OF THE INVENTION

The present invention provides a cleaning formulation comprising: (A) an aqueous solvent comprising water; (B) an active component comprising an organic solvent; and (C) a coupling agent comprising an alkylene glycol dilevulinate. The alkylene glycol dilevulinate has the general formula, $CH_3C(O)CH_2CH_2C(O)O—R—O(O)CCH_2CH_2C(O)CH_3$, wherein R is a $C_2$-$C_8$ straight chain or branched alkylene moiety, and the two levulinate groups ($CH_3C(O)CH_2CH_2C(O)O—$) may be attached to adjacent, or non-adjacent, carbon atoms of the alkylene moiety. In some embodiments, for example, R may be a $C_2$-$C_3$ alkylene moiety, and the alkylene glycol dilevulinate may be selected from the group consisting of: ethylene glycol dilevulinate, 1,2-propylene glycol dilevulinate and 1,3-propylene glycol dilevulinate.

The organic solvent may have a solubility of no more than 10%, or no more than 5%, by weight, in water at 25° C. and atmospheric pressure, based on the total weight of the organic solvent and water in solution. Furthermore, the organic solvent may be at least one compound selected from the group consisting of: an aliphatic hydrocarbon, an aromatic hydrocarbon, a chlorinated hydrocarbon, a terpene, lemon oil, pine oil, methyl soyate and d-limonene.

In one embodiment of the cleaning formulation of the present invention, the aqueous solvent comprising water (A) may be present in an amount of from 90% to 98% by weight, the active component comprising an organic solvent (B) may be present in an amount of from 0.1% to 5.0% by weight, and the coupling agent comprising an alkylene glycol dilevulinate (C) may be present in an amount of from 0.1% to 6.0%, all weight percentages based on the total weight of the cleaning formulation.

BRIEF DESCRIPTION OF THE DRAWINGS

A more complete understanding of the present invention will be gained from the embodiments discussed hereinafter and with reference to the accompanying figures in which.

DETAILED DESCRIPTION OF THE INVENTION

Figure 1:
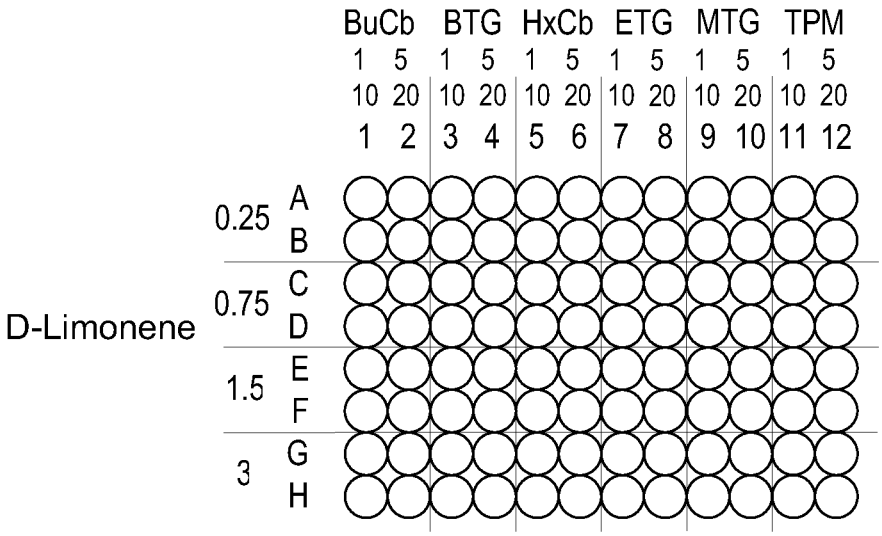
FIG. 1 is a schematic grid diagram of the general layout of sample formulations, each containing various types of glycol ethers as coupling agents, various amounts of d-limonene fragrance, and 1% sodium lauryl sulfate (SLS) surfactant, which were tested for coupling effectiveness as shown in FIGS. 2-4.
Figure 2:
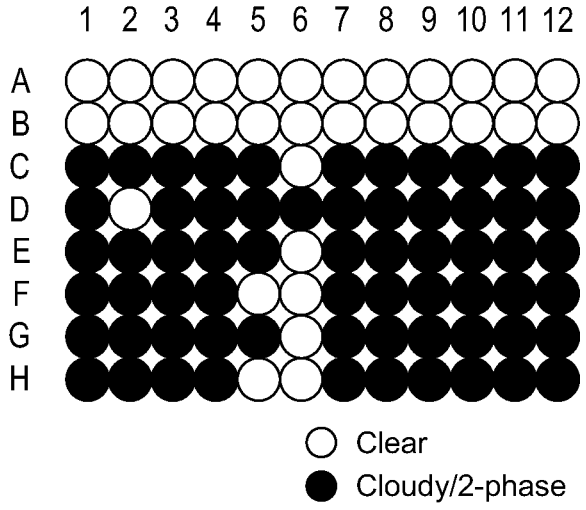
FIGS. 2, 3 and 4 are diagrams in accordance with the general layout of FIG. 1, showing coupling effectiveness of the glycol ethers at 25° C., 40° C. and 5° C., respectively.
Figure 3:
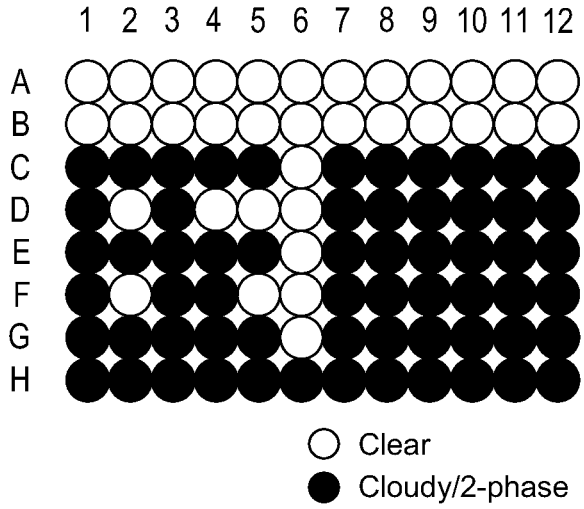
Figure 4:
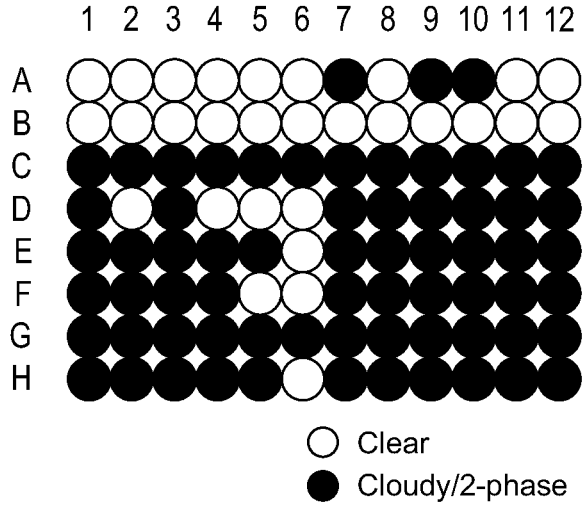

The present invention relates to the use of alkylene glycol dilevulinates or mixtures of alkylene glycol dilevulinates in water-based cleaning formulations to couple active components comprising organic compounds such as solvents or fragrances, having low or zero water solubility, with water. Alkylene glycol dilevulinates can be economically produced from levulinic acid and a glycol. Levulinic acid is available from biomass and is, therefore, a renewable environmentally-friendly resource. Additionally, glycols such as 1,2-propylene glycol and 1,3-propylene glycol are biorenewable and, therefore, also environmentally-friendly materials.

Alkylene glycol dilevulinates are high boiling, clear liquids with minimal odor and are not volatile organic compounds (VOCs). These particular characteristics provide benefits and advantages to their use as alternative coupling agents in water-based cleaning formulations. For example, traditional coupling agents such as propylene glycol, diethylene glycol and lower glycol ethers are volatile organic compounds (VOCs) which are environmentally undesirable. Also, with the exception of dipropylene glycol methyl ether, glycol ethers are not as effective couplers as the alkylene glycol dilevulinates. The alkylene glycol dilevulinates are partially to completely water soluble and are not VOCs. Since it is widely understood by persons of ordinary skill in the relevant art that diesters are typically not water soluble, the fact that alkylene glycol dilevulinates are water soluble and, therefore, useful as coupling agents in water-based systems is a surprising and unexpected benefit. Furthermore, applicants have discovered that alkylene glycol dilevulinates provide better coupling performance which allows the use of greater amounts of organic solvents having low or zero water solubility with water, than when traditional coupling agents are used. Inclusion of greater amounts of the organic solvents increases cleaning efficiency while maintaining preferred formulation characteristics such as homogeneity, clarity, stability and viscosity.

It is also believed that alkylene glycol dilevulinates could be particularly useful in aerosol products such as hair care products, sanitizers, and insecticides, and spray applied consumer products. These dilevulinate solvents allow the formulation of more efficient, safer and more environmentally friendly formulations and may facilitate the development of many novel formulations suitable for cleaning, coatings, pigment dispersants, pesticides, and agricultural applications.

As used hereinafter, the terms "an alkylene glycol dilevulinate" and "alkylene glycol dilevulinates" are both meant to include the presence of one or more compounds having the general formula, $CH_3C(O)CH_2CH_2C(O)O—R—O(O)CCH_2CH_2C(O)CH_3$, wherein R is a $C_2$-$C_8$ straight chain or branched alkylene moiety, and the two levulinate groups ($CH_3C(O)CH_2CH_2C(O)O—$) may be attached to adjacent, or non-adjacent, carbon atoms of the alkylene moiety. Thus, an "alkylene glycol dilevuninate" may be one compound which satisfies the foregoing general formula, or a mixture of such compounds. Where a mixture of alkylene glycol dilevulinates is synthesized or otherwise available, it is not necessary that the various species from one another before using the mixture in a cleaning formulation in accordance with the present invention.

As also used hereinafter, the term "organic active components" is meant to include organic materials that perform a particular function in the cleaning formulations, such as organic solvents, fragrances, etc. "Organic solvents," as the term is used herein, means compounds that dissolve, soften, melt, or extract another compound, such as grease, soil, oil, paint, glue, stains, etc., and which are, therefore, commonly used in cleaning formulations. Typical organic solvents include, without limitation, aliphatic hydrocarbons, isoparaffins, aromatic hydrocarbons, chlorinated hydrocarbons, and terpenes, among others. "Fragrances," as the term is used herein, means organic compounds that impart a particular odor to the cleaning formulation, and may or may not also provide the same function as organic solvents. Typical fragrances include, for example, d-limonene, lemon oil and pine oil.

The term "coupling agents" as used herein means compounds that facilitate dissolution and dispersion of organic solvents, into water-based formulations, in greater amounts than otherwise possible, while the formulations retain their preferred characteristics of clarity, viscosity and homogeneity. Traditional coupling agents used in cleaning formulations include, without limitation, propylene glycol, diethylene glycol, glycol ethers, and some surfactants, among others.

It is noted that in the following description, endpoints of ranges are considered to be definite and are recognized to incorporate within their tolerance other values within the knowledge of persons of ordinary skill in the art, including, but not limited to, those which are insignificantly different from the respective endpoint as related to this invention (in other words, endpoints are to be construed to incorporate values "about" or "close" or "near" to each respective endpoint). The range and ratio limits, recited herein, are combinable. For example, if ranges of 1-20 and 5-15 are recited for a particular parameter, it is understood that ranges of 1-5, 1-15, 5-20, or 15-20 are also contemplated and encompassed thereby.

All percentages stated herein are weight percentages, unless otherwise stated.

The cleaning formulations of the present invention comprise an aqueous solvent comprising water, an active component comprising at least one organic solvent, and at least one alkylene glycol dilevulinate.

The aqueous solvent may comprise up to 100% water. Furthermore, cleaning formulation may comprise the aqueous solvent comprising water in an amount between 70 and 98% by weight, based on the total weight of the formulation. For example, the aqueous solvent comprising water may be present in an amount between 94 and 98% by weight.

The organic active component may be an organic solvent or fragrance and may have a solubility in water of not more than 10% by weight at 25° C. and atmospheric pressure, or for example, not more than 5%, or even 1%, by weight at 25° C. and atmospheric pressure, based on the total weight of the organic solvent or fragrance and water in solution. Typical examples include, without limitation, d-limonene, lemon oil, pine oil, methyl soyate, and terpenes.

In accordance with the present invention, the cleaning formulations may comprise an organic active component in an amount between 0.1 to 20.0% by weight, based on the total weight of the formulation. For example, without limitation, the organic active component may be present in an amount between 0.5 to 3.0% by weight.

The alkylene glycol dilevulinates suitable for use in the present invention are lower alkylene glycol dilevulinates of general formula $CH_3C(O)CH_2CH_2C(O)O—R—O(O)CCH_2CH_2C(O)CH_3$, derived from alkylene glycols having the general formula HO—R—OH, wherein R is a $C_2$-$C_8$ straight chain or branched alkylene moiety, and the two hydroxyl groups may be on adjacent carbons, for example ethylene glycol and 1,2-propylene glycol, or on non-adjacent carbons, for example 1,3-propanediol or 1,6-hexanediol. Particularly suitable are alkylene glycol dilevulinates of the foregoing general formula, wherein R is a $C_2$-$C_3$ alkylene, such as ethylene, 1,2-propylene, or 1,3-propylene.

In particular, applicants have found that diesters of ethylene glycol, 1,2-propylene glycol, and 1,3-propylene glycol with levulinic acid are surprisingly good solvents for coupling aromatic and aliphatic hydrocarbons and other organic materials with water. Ethylene glycol dilevulinate (EGDL) is 100% water soluble while 1,2-propylene glycol dilevulinate (1,2-PGDL) is 10% soluble by weight in water, and 1,3-propylene glycol dilevulinate (1,3-PGDL) is 25% soluble. All three compounds also dissolve aromatic hydrocarbon compounds such as toluene and xylene, while having limited solubility for simple aliphatic hydrocarbons such as hexane and cyclohexane. Thus, $C_2$-$C_3$ alkylene glycol dilevulinates appear to provide the greatest benefits when used as coupling agents in water-based cleaning formulations.

The cleaning formulations may suitably comprise the alkylene glycol dilevulinate in an amount between 0.1 and 6.0% by weight, based on the total weight of the formulation. For example, without limitation, the alkylene glycol dilevulinate may be present in the cleaning formulations in an amount between 0.5 and 3.0% by weight.

Processes for preparing esters of levulinates are well known and commercially practiced. For example, International Patent Application No. WO 2010/102203 describes reacting furfuryl alcohol with other alcohols (e.g., methanol, ethanol, propanol, isopropanol, butanol, and isobutanol), in equimolar amounts, in the presence of an acid catalyst, to produce corresponding alkyl levulinates.

Alkylene glycol dilevulinates suitable for use in accordance with the cleaning formulation of the present invention may be prepared by any process known now or in the future and is not particularly limited. For example, U.S. Pat. No. 2,654,723 describes the preparation of diethylene glycol dilevulinate to involve mixing appropriate amounts of levulinic acid, diethylene glycol and toluene (as the reaction solvent), heating the mixture to react the levulinic acid and diethylene glycol and to remove water produced by that reaction, followed by removing the toluene by stripping to yield an amount of diethylene glycol dilevulinate, which has a boiling point above 200° C. From this source, it is seen that production of a dilevulinate from levulinic acid and an alkylene glycol requires providing these reactants at a molar ratio of (levulinic acid):(alkylene glycol) of at least 2:1.

Laboratory quantities of the glycol dilevulinates may be conveniently prepared, for instance, by the method described in the examples provided hereinbelow.

Thus, alkylene glycol dilevulinates suitable for use in the present invention include, without limitation, those prepared from any linear or branched $C_2$-$C_8$ mono-, di-, or tri-alkylene glycol, and levulinic acid.

As with other, known cleaning formulations, cleaning formulations in accordance with the present invention may contain ingredients in addition to water, an organic active component and a coupling agent. For example, the cleaning formulations may also comprise one or more surfactants, buffers, chelating agents, biocides, fragrances, viscosity modifiers, colorants, and polymers, among other things.

Suitable surfactants, for example include, without limitation, sodium linear alkylbenzene sulfonates, alkyl sulfates, alpha olefin sulfonates, acyl sarcosinates, sodium salt of coconut fatty acids, sulfonated alkyl esters, alkyl polyglucosides, primary alcohol ethoxylates, alkyl polypentasides, secondary alcohol ethoxylates, EO-PO and EO-BO block polymers, and sodium 3-dodecylamino-propionate.

Suitable buffers include, for example, without limitation, sodium hydroxide (NaOH), alkanolamines, amines, ammonia, alkali metal carboxylates, citric acid, sodium citrate, and lactic acid. Suitable chelating agents, for example include, without limitation, ethylene diamine-N,N'-tetraacetic acid, the mono-, di-, tri-, and tetra sodium salts of (EDTA), nitriloacetic acid, trisodium salt (NTA), hydroxyl ethyl iminodiacetic acid, disodium salt (HEIDA), methyl glycinediacetic acid, trisodium salt (MGDA), glutamic acid, N,N-diacetic acid tetrasodium salt (GLDA), iminodiacetic acid, tetrasodium salt, (IDS), tri(hydroxymethyl)amino methane (TRIS), 2-amino-2-ethyl 1,3-propanediol, 2-amino-2-methyl propanol, 2-amino-2-methyl-1,3-propanediol, and polyamines.

Suitable colorants, for example include, without limitation, dyes.

Polymers suitable for use in the cleaning formulations of the present invention, for example include, without limitation, polyacrylate homopolymers and copolymers, METHOCELs, ETHOCELs, hydroxyethyl cellulose, POLYOXs, polyethylene glycols, polypropylene glycols, polyvinylpyrrolidones, and polyvinyl alcohols.

The use, application and benefits of the present invention will be clarified by the following discussion and description of exemplary embodiments and applications of the cleaning formulations of the present invention.

EXAMPLES

Preparation of Ethylene Glycol Dilevulinate

In the laboratory, we prepared the glycol dilevulinates using an acid catalyst (Dowex DR-2030 resin beads, a strong cation exchange resin) and the procedure described below:

Ethylene glycol (99.17 g, 1.598 moles), levulinic acid (378.4 g, 3.259 moles), and 8.08 g of Dowex DR-2030 resin beads were placed in a 1 L round-bottom flask. The flask was attached to a Büchi Rotavapor and heated in a 95° C. bath while water aspirator vacuum was applied. Water produced by the reaction was collected in the Rotavapor catch flask. After 14 hours, the Dowex DR-2030 beads were filtered from the orange solution which was placed in a 500 mL round-bottom flask. A 1 foot jacketed Vigreux column surmounted by a standard vacuum distillation head with a thermometer and water-cooled condensing finger was attached to the flask, and distillation at about 0.5 mm Hg at elevated temperature was begun. Six fractions were then collected at increasing distillation temperatures. Fractions 3 to 5 ranged from 95 to 98 area % purity based on gas chromatographic analysis, and represented an overall 67% yield based on ethylene glycol used. Identity of the product as ethylene glycol dilevulinate was confirmed by $^{1}H$ and $^{13}C$ NMR spectroscopy.

1,3-propanediol dilevulinate and 1,2-propanediol dilevulinate were prepared in a similar manner with overall yields of 70% and 59% respectively.

Examples 1-24

Relative Coupling Effectiveness with Fragrances

The following study was performed to evaluate the stability and coupling capabilities of alkylene glycol dilevulinates in different formulations containing one of three fragrances, outdoor, orange, lemon.

To speed up the preparation of cleaning formulations for testing, we created stock solutions that contained the main components which didn't change throughout Examples 1-24, along with stock solutions with surfactant combinations. These stock solutions were used along with the other components to formulate the samples by weight percent. 20-gram samples of each formulation were prepared.

Each formulation contained the following ingredients in the following amounts shown in the following TABLE OF STANDARD INGREDIENTS Examples 1-24:

Table of Standard Ingredients

Examples 1-24

| Name | Amount (wt %) | Description/Comment |
|---|---|---|
| VERSENE HEIDA | 1.00 | Chelating agent, commercially available from the Dow Chemical Company of Midland, Michigan, U.S.A. |

-continued

| Name | Amount (wt %) | Description/Comment |
|---|---|---|
| | | An aqueous solution of disodium ethanoldiglycine which is readily biodegradable. It is particularly useful for chelation of iron in mildly alkaline solutions |
| Diisopropanolamine (DiPA) | 0.50 | A buffer, replaces traditional monoethanolamine (MEA) buffer |
| Sodium Hydroxide (NaOH) | 0.20 | Buffer, pH adjuster |
| Water | variable | Aqueous solvent |
| Fragrance | 0.50 | one of the following as listed in TABLE 1<br>"outdoor"<br>"orange"<br>"lemon" |

Coupling Agents/Solvents Tested

Each formulation contained 2.00 wt % of one of the following solvent/couplers, as indicated in TABLE 1:

PG-Dilevulinate=1,2-propylene glycol dilevulinate 1,3-PG-Dilevulinate=1,3-propylene glycol dilevulinate EG-Dilevulinate=ethylene glycol dilevulinate DOWANOL DPnP=di-propylene glycol propyl ether (a P-series glycol ether)

After the desired formulations with the fragrances were prepared, we checked their stability at 5° C., 20° C., and 50° C. and noted if the sample was clear, hazy or cloudy. To evaluate slight haze, we took a piece of paper with black text written on it, and held it behind the vial containing the formulation. If we could see the black text clearly, we noted the formulation as clear. If we could not see the text at all, we noted the formulation as cloudy. Finally, if we could see the text, but it was not a vibrant black, the formulation was described as hazy. The less haze or cloudiness, the better the coupling achieved between the water and the fragrance (organic solvent)

The following TABLE 1 presents the results of testing various formulations containing difficult-to-couple fragrances (organic active ingredients), i.e., "outdoor", "orange" and "lemon," using the aforesaid testing procedure.

TABLE 1

| | | | "Green" Surfactants ** | | | | Stability | | |
|---|---|---|---|---|---|---|---|---|---|
| | Fragrance (0.5%) | Solvent/Coupler (2.00 wt %) | TERGITOL 15-S-15 | ECOSURF EH-6 | ECOSURF EH-9 | % Water | 5° C. | 20° C. | 50° C. |
| 1 | Outdoor | PG-Dilevulinate | 0.50 | 0.25 | 0.25 | 95.30 | Cloudy | Haze | Cloudy |
| 2 | Outdoor | PG-Dilevulinate | 1.00 | 0.50 | 0.50 | 94.30 | Clear | Clear | Cloudy |
| 3 | Orange | PG-Dilevulinate | 0.50 | 0.25 | 0.25 | 95.30 | Haze | Clear | Cloudy |
| 4 | Orange | PG-Dilevulinate | 1.00 | 0.50 | 0.50 | 94.30 | Clear | Clear | Cloudy |
| 5 | Lemon | PG-Dilevulinate | 0.50 | 0.25 | 0.25 | 95.30 | Clear | Clear | Cloudy |
| 6 | Lemon | PG-Dilevulinate | 1.00 | 0.50 | 0.50 | 94.30 | Clear | Clear | Clear |
| 7 | Outdoor | 1,3-PG-Dilevulinate | 0.50 | 0.25 | 0.25 | 95.30 | Cloudy | Haze | Cloudy |
| 8 | Outdoor | 1,3-PG-Dilevulinate | 1.00 | 0.50 | 0.50 | 94.30 | Clear | Clear | Clear |
| 9 | Orange | 1,3-PG-Dilevulinate | 0.50 | 0.25 | 0.25 | 95.30 | Clear | Clear | Cloudy |
| 10 | Orange | 1,3-PG-Dilevulinate | 1.00 | 0.50 | 0.50 | 94.30 | Clear | Clear | Clear |
| 11 | Lemon | 1,3-PG-Dilevulinate | 0.50 | 0.25 | 0.25 | 95.30 | Clear | Clear | Cloudy |
| 12 | Lemon | 1,3-PG-Dilevulinate | 1.00 | 0.50 | 0.50 | 94.30 | Clear | Clear | Clear |
| 13 | Outdoor | EG-Dilevulinate | 0.50 | 0.25 | 0.25 | 95.30 | Clear | Clear | Cloudy |
| 14 | Outdoor | EG-Dilevulinate | 1.00 | 0.50 | 0.50 | 94.30 | Clear | Clear | Clear |
| 15 | Orange | EG-Dilevulinate | 0.50 | 0.25 | 0.25 | 95.30 | Clear | Clear | Cloudy |
| 16 | Orange | EG-Dilevulinate | 1.00 | 0.50 | 0.50 | 94.30 | Clear | Clear | Clear |
| 17 | Lemon | EG-Dilevulinate | 0.50 | 0.25 | 0.25 | 95.30 | Clear | Clear | Cloudy |
| 18 | Lemon | EG-Dilevulinate | 1.00 | 0.50 | 0.50 | 94.30 | Clear | Clear | Clear |
| 19 | Outdoor | DOWANOL DPnP | 0.50 | 0.25 | 0.25 | 95.30 | Haze | Cloudy | Clear |
| 20 | Outdoor | DOWANOL DPnP | 1.00 | 0.50 | 0.50 | 94.30 | Clear | Clear | Clear |
| 21 | Orange | DOWANOL DPnP | 0.50 | 0.25 | 0.25 | 95.30 | Clear | Haze | Cloudy |
| 22 | Orange | DOWANOL DPnP | 1.00 | 0.50 | 0.50 | 94.30 | Clear | Clear | Clear |

TABLE 1-continued

| | Fragrance (0.5%) | Solvent/Coupler (2.00 wt %) | "Green" Surfactants ** TERGITOL 15-S-15 | ECOSURF EH-6 | ECOSURF EH-9 | % Water | Stability 5° C. | 20° C. | 50° C. |
|---|---|---|---|---|---|---|---|---|---|
| 23 | Lemon | DOWANOL DPnP | 0.50 | 0.25 | 0.25 | 95.30 | Clear | Haze | Clear |
| 24 | Lemon | DOWANOL DPnP | 1.00 | 0.50 | 0.50 | 94.30 | Clear | Clear | Clear |

** Green Surfactants: each formulation also contained one of two possible combinations of three eco-friendly surfactants, each of which is commercially available from Dow Chemical Company of Midland, Michigan, U.S.A.:
TERGITOL 15-S-15 = a high hydrophilic-lipophilic balance emulsifier and dispersant
ECOSURF EH-6 = a water soluble nonionic surfactant
ECOSURF EH-9 = a water soluble nonionic surfactant

Example Set I (Comparative) & Set II (Working)

FIGS. 1-16

Two sets of experiments (I & II) were performed to determine the relative coupling effectiveness of fragrance (d-limonene)-containing aqueous formulations having various traditional coupling agents (glycol ethers) and those having various alkylene glycol dilevulinates as the coupling agents, at various temperatures (5° C., room temperature (25° C.) and 40° C.). The details are provided below and the results are shown in diagrams provided in FIGS. 1-16 and explained hereinbelow.

Stock solutions were prepared that contained the main components which didn't change throughout these experiments. Each formulation contained the following standard ingredients:

Table of Standard Ingredients

Sets I & II

| Name | Amount (wt %) | Description/Comment |
|---|---|---|
| sodium lauryl sulfate (SLS) | none or 1% | Surfactant |
| Water | variable | Aqueous solvent |
| D-Limonene (fragrance) | various | Amounts of fragrance were varied among 0.5%, 0.75%, 1.5% and 3% by weight |

More particularly, the cleaning formulations were in either:

Set I—Comparative Examples (see FIGS. 1-8), which included a known coupling agent selected from one of the following glycol ethers, in an amount of 1, 5, 10 or 20 weight percent as indicated in the figures:

BuCb=diethylene glycol n-butyl ether
BTG=triethylene glycol n-butyl ether
HxCb=diethylene glycol n-hexyl ether
ETG=triethylene glycol ethyl ether
MTG=triethylene glycol methyl ether
TPM=tripropylene glycol methyl ether or the Set II—Working Examples (see FIGS. 9-16) that included an alkylene glycol dilevulinate according to the present invention, or DOWANOL DPM, dipropylene glycol monomethyl ether, in an amount of 1, 5, 10 or 20 weight percent, and selected from the following compounds:

1,2 EGDL=ethylene glycol dilevulinate,
1,2-PGDL=1,2-propylene glycol dilevulinate,
1,3-PGDL=1,3-propylene glycol dilevulinate,
1,2 EGDL+1,2-PGDL=50/50 mix of 1,2-ethylene glycol dilevulinate and 1,2-propylene glycol dilevulinate,
DPM=dipropylene glycol methyl ether.

Figure 5:
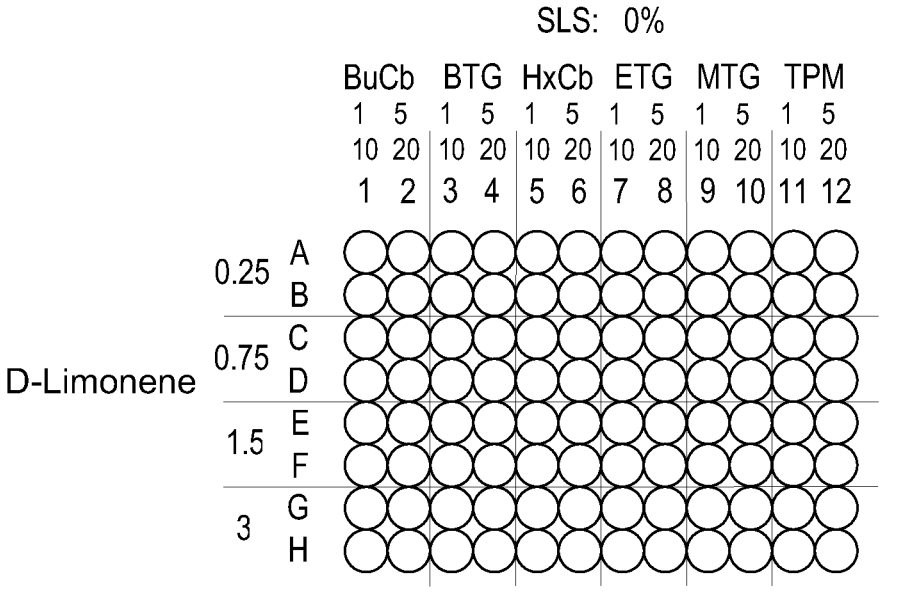
FIG. 5 is a schematic grid diagram of the general layout of sample formulations, each containing various types of glycol ethers as coupling agents, various amounts of d-limonene fragrance, and 0% SLS surfactant, which were tested for coupling effectiveness as shown in FIGS. 6-8.

With reference now to the figures, FIGS. 1-8 relate to the Set of Comparative Examples. Each circle represents one sample formulation. More particularly, each of FIGS. 1 & 5 provide a schematic grid diagram of the general layout of sample formulations having various types of glycol ethers as coupling agents and various amounts of d-limonene fragrance, in the presence of 1% SLS surfactant and absence (0% SLS) of surfactant.

For instance, rows A & B of the grid in FIG. 1 were formulations that each had 0.25% by weight d-limonene. Thus, rows A & B of each of FIGS. 2-4 & 6-8 depict formulations that had 0.25% by weight d-limonene.

Columns 1 & 2 of the grid in FIG. 1 were formulations that contained various amounts of BuCb, a glycol ether, as the coupling agent. More specifically, Column 1 of the grid in FIG. 1 shows that for each vertical pair of formulations, the top formulation had 1% by weight BuCb and the bottom one had 10% by weight BuCb. Similarly, Column 2 of the grid in FIG. 1 shows that for each vertical pair of formulations, the top formulation had 5% by weight BuCb and the bottom one had 20% by weight BuCb. This information can be similarly translated to Columns 1 & 2 of FIGS. 2-4.

Thus, to provide a random example, the sample formulation at Row D, Column 6 contained the standard ingredients listed in the TABLE above for Sets I & II, as well as 0.75% by weight d-limonene and 20% by weight HxCb as the coupling agent, based on the total weight of the formulation.

FIGS. 2-4 & 6-8 show the results (clear/white or cloudy/black) for the sample formulations identified in the grids of FIGS. 1 and 5 at 5° C., room temperature (25° C.), and 40° C., respectively. Clear indicates successful coupling of the d-limonene and cloudy indicates poor or no coupling.

Figure 6:
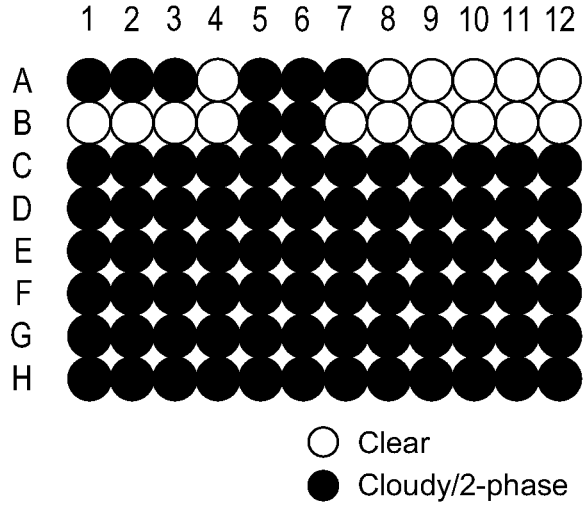
FIGS. 6, 7 and 8 are diagrams in accordance with the general layout of FIG. 5, showing coupling effectiveness of the glycol ethers at 25° C., 40° C. and 5° C., respectively.
Figure 7:
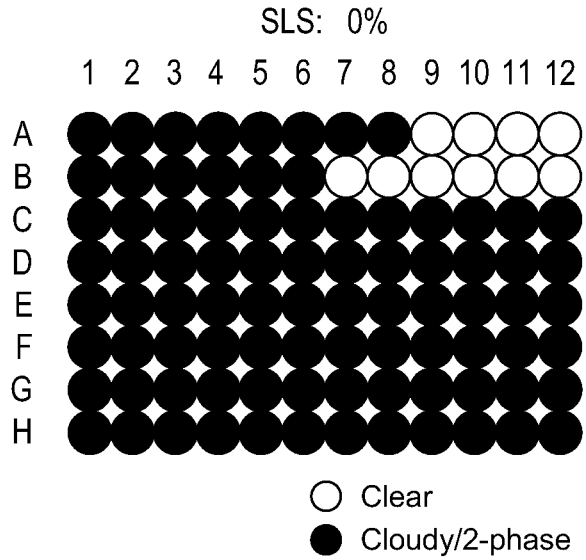
Figure 8:
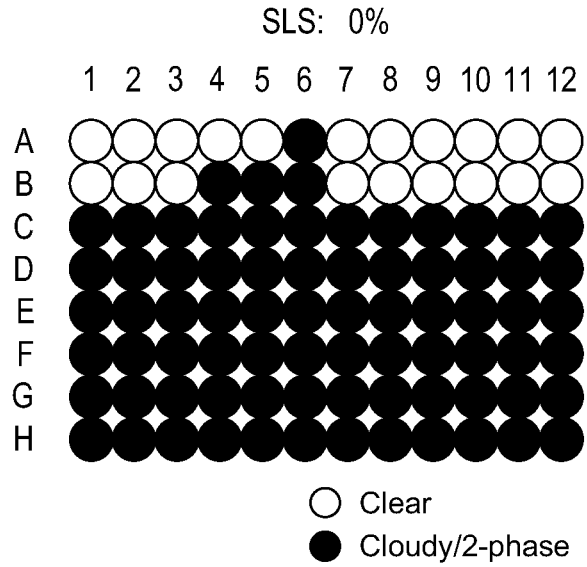

Generally speaking, a review of FIGS. 6-8 appears to indicate that the glycol ethers were somewhat successful at coupling d-limonene in aqueous formulations, but only when the amount of d-limonene is relatively low, i.e., 0.25% by weight.

More specifically, sample formulation at Row D, Column 6 which contained 0.75% by weight d-limonene and 20% by weight HxCb, was cloudy at 5° C. (FIG. 2), clear at room temperature (FIG. 3), and cloudy at 40° C.

Figure 9:
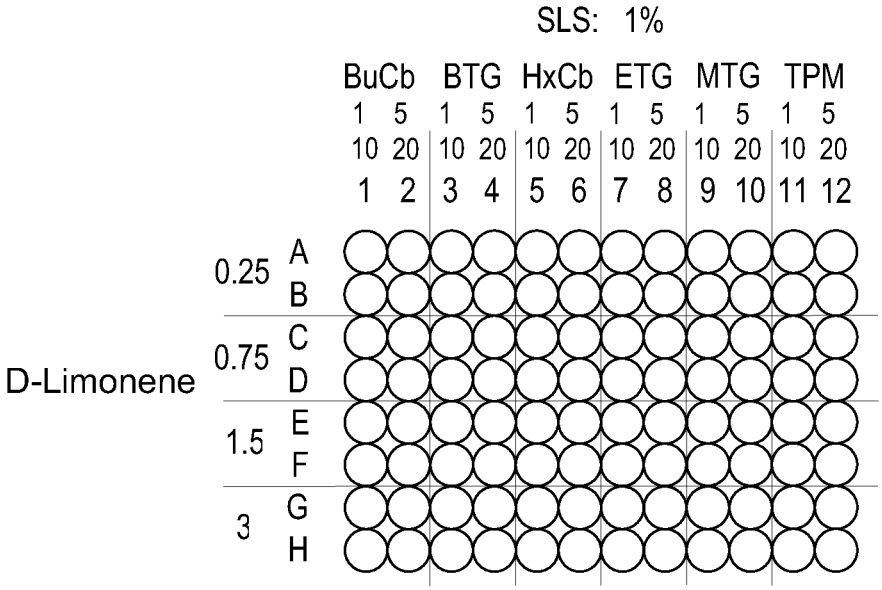
FIG. 9 is a schematic grid diagram of the general layout of sample formulations, each containing various types of alkylene glycol dilevulinates as coupling agents, various amounts of d-limonene fragrance, and 1% SLS surfactant, and tested for stability as shown in FIGS. 10-12.
Figure 10:
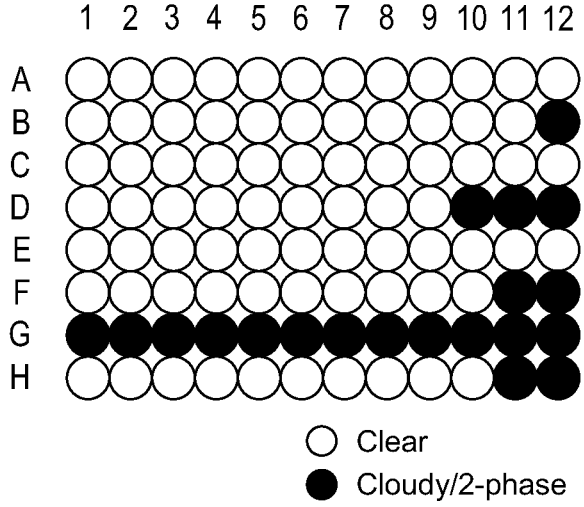
FIGS. 10, 11 and 12 are diagrams in accordance with the general layout of FIG. 9, showing the stability of formulations containing the alkylene glycol dilevulinates at 25° C., 40° C. and 5° C., respectively.
Figure 11:
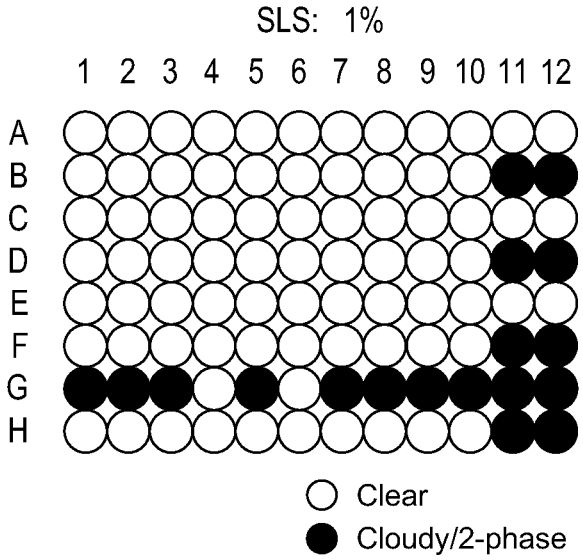
Figure 12:
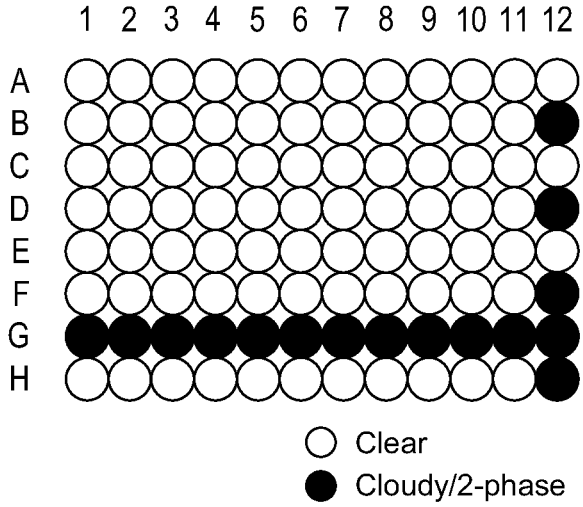

FIGS. 9-16 relate to the Set II of Working Examples. As with FIGS. 1-8, each circle represents one sample formulation. More particularly, FIG. 9 provides a schematic grid diagram of the general layout of sample formulations having various types of alkylene glycol dilevulinates as coupling agents and various amounts of d-limonene fragrance. For instance, rows A & B of the grid in FIG. 9 were formulations that each had 0.25% by weight d-limonene. Thus, rows A & B of each of FIGS. 10-12 & 14-16 depict formulations that had 0.25% by weight d-limonene.

Furthermore, Columns 1 & 2 of the grid in FIG. 9 were formulations that contained various amounts of 1,2-ethylene glycol dilevulinate (1,2-EGDL) as the coupling agent, in accordance with the present invention. More specifically, Column 1 of the grid in FIG. 9 shows that for each vertical pair of formulations, the top formulation had 1% by weight 1,2-EGDL and the bottom one had 10% by weight 1,2-EGDL. Similarly, Column 2 of the grid in FIG. 9 shows that for each vertical pair of formulations, the top formulation had 5% by weight 1,2-EGDL and the bottom one had 20% by weight 1,2-EGDL. This information can be similarly translated to Columns 1 & 2 of FIGS. 10-12 & 14-16.

Thus, to provide a random example, the sample formulation at Row F, Column 6 contained the standard ingredients listed in the TABLE above for Sets I & II, as well as 1.5% by weight d-limonene and 20% by weight 1,2-EGDL as the coupling agent, based on the total weight of the formulation.

Figure 13:
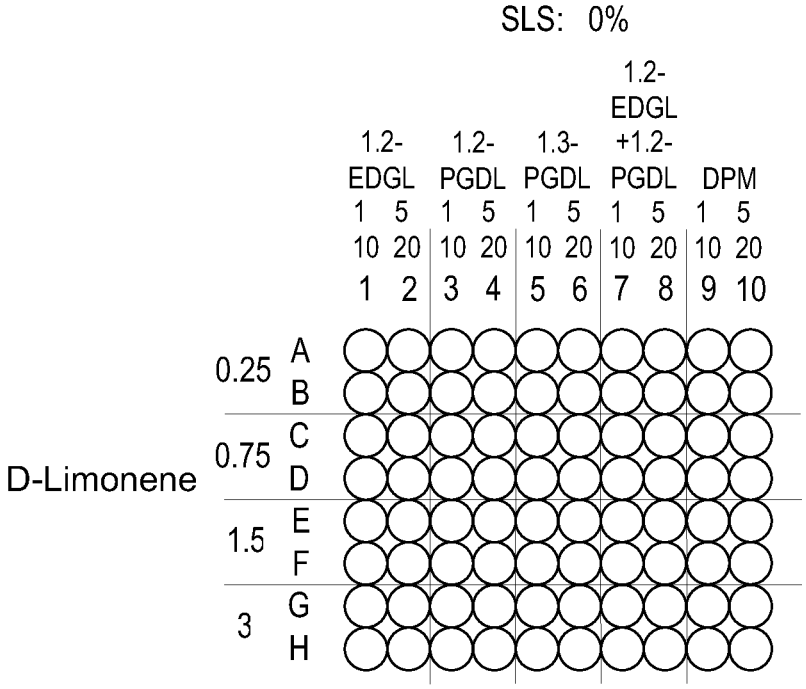
FIG. 13 is a schematic grid diagram of the general layout of sample formulations, each containing various types of alkylene glycol dilevulinates as coupling agents, various amounts of d-limonene fragrance, and 0% SLS surfactant, and tested for stability as shown in FIGS. 14-16.
Figure 14:
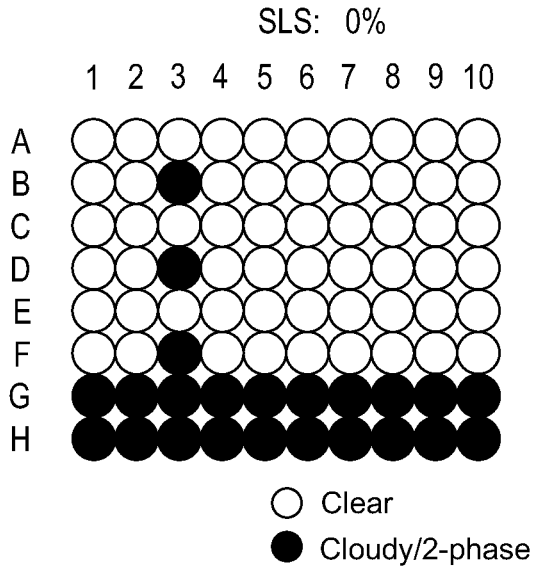
FIGS. 14, 15 and 16 are diagrams in accordance with the general layout of FIG. 13, showing stability of formulations containing the alkylene glycol dilevulinates at 25° C., 40° C. and 5° C., respectively.
Figure 15:
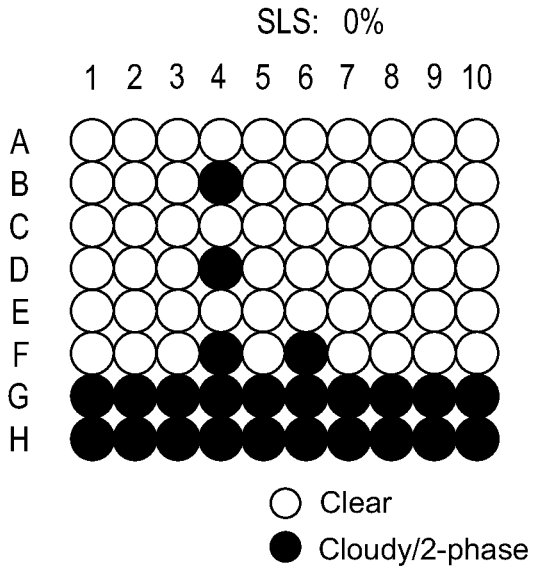
Figure 16:
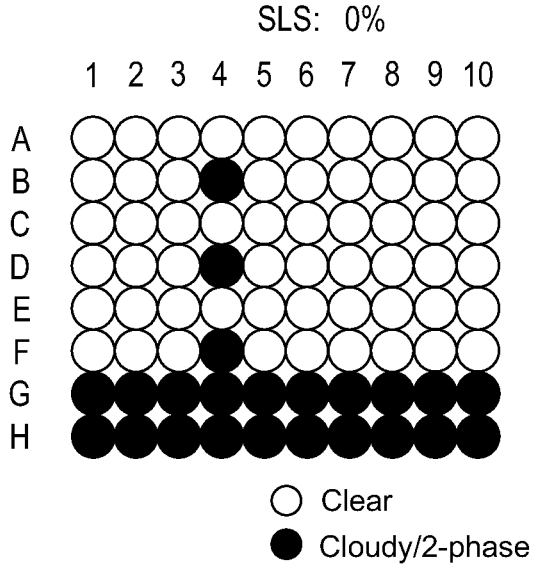

FIGS. 10-12 & 14-16 show the results (clear/white or cloudy/black) for the sample formulations identified in the grids of FIGS. 9 & 13 at 5° C., room temperature (25° C.), and 40° C., respectively. Clear indicates successful coupling of the d-limonene and cloudy indicates poor or no coupling.

Generally speaking, a review of FIGS. 10-12 & 14-16 appears to indicate that the alkylene glycol dilevulinates are more successful at coupling d-limonene in aqueous formulations over a broader range of temperatures and concentrations of d-limonene than the commonly used glycol ethers.

More specifically, sample formulation at Row F, Column 6 which contained 1.5% by weight d-limonene and 20% by weight 1,2-EGDL, was clear at 5° C. (FIG. 2), clear at room temperature (FIG. 3), and cloudy at 40° C.

FIGS. 1-16 showed the phase stability data of glycol ethers and alkylene glycol dilevulinates with varying levels of d-limonene in the presence of 1% SLS surfactant and absence (0% SLS) of surfactant.

In the absence of added SLS surfactant, most of the glycol ether solvents tested were unable to couple more than 0.25% d-limonene into an aqueous mixture. The only exception was DOWANOL DPM. In contrast, the experimental glycol dilevulinate solvents were fairly effective at coupling d-limonene in the absence of surfactant. Ethylene glycol dilevulinate and 1,3-propylene glycol dilevulinate were better than 1,2-propylene glycol dilevulinate. This is in agreement with their observed water solubility.

In the presence of 1% SLS, all of the solvents tested showed improvement in probability to be clear. Hexyl CARBITOL, DOWANOL DPM, and the glycol dilevulinate solvents at a 20% level were able to successfully couple even the highest d-limonene level tested, 3%.

Examples A-FF

Relative Cleaning Performance of Formulations

These experiments were intended to measure how well cleaning formulations containing various solvent/coupling agents, as well as different combinations of surfactants, performed in terms of leaving films or streaks, and how efficiently they cleaned.

Again, we created stock solutions that contained the main components which didn't change throughout each set of formulations, along with stock solutions with surfactant combinations, being either 0.5% or 1.0% total surfactant as shown in TABLE 2 below. These stock solutions were used along with the other components to formulate the samples by weight percent. None of these sample formulations contained any fragrance since the goal was to see how well the cleaning formulations containing different coupling agent and surfactant combinations cleaned. 20-gram samples of each formulation were prepared.

Each formulation contained the following ingredients in the following amounts shown in the following TABLE OF STANDARD INGREDIENTS Examples A-FF:

Table of Standard Ingredients

Examples A-FF

| Name | Amount (wt %) | Description/Comment |
|---|---|---|
| VERSENE HEIDA | 0.5 | Chelating agent, commercially available from the Dow Chemical Company of Midland, Michigan, U.S.A. An aqueous solution of disodium ethanoldiglycine which is readily biodegradeable. It is particularly useful for chelation of iron in mildly alkaline solutions |
| Diisopropanolamine (DiPA) | 0.50 | A buffer, replaces traditional monoethanolamine (MEA) buffer |
| Sodium Hydroxide (NaOH) | 0.20 | Buffer, pH adjuster |
| Water | variable | Aqueous solvent |

Coupling Agents/Solvents Tested

Each formulation contained 1.00 wt % of one of the following solvent/couplers, as indicated in TABLE 2:

PGDL=PG-Dilevulinate=1,2-propylene glycol dilevulinate 1,3PGDL=1,3-PG-Dilevulinate=1,3-propylene glycol dilevulinate EGDL=EG-Dilevulinate=ethylene glycol dilevulinate DPnP=DOWANOL DPnP=di-propylene glycol propyl ether (a P-series glycol ether)

Surfactants and Combinations Thereof Tested

Each formulation contained a total of either 0.5% or 1.0% surfactants, as follows and indicated in TABLE 2 below:

Different combinations of the following three eco-friendly ("green") surfactants, but always totaling either 0.5 or 1.0 wt %, were tested among the cleaning formulations. Each of the following surfactants is commercially available from Dow Chemical Company of Midland, Mich., U.S.A.:

TERGITOL 15-S-15=a high hydrophilic-lipophilic balance emulsifier and dispersant ECOSURF EH-6=a water soluble nonionic surfactant ECOSURF EH-9=a water soluble nonionic surfactant For some formulations, one of the following other, less environmentally-friendly materials (both commercially available from Shell Chemical LP of Houston, Tex., U.S.A.) was substituted for the surfactant in amounts of either 0.5 or 1.0 wt %.

NEODOL 25-7=a $C_{12}$-$C_{15}$ alcohol mixture containing an average of 7 moles of ethylene oxide per mole of alcohol.

NEODOL 45-7=a $C_{14}$-$C_{15}$ alcohol mixture containing an average of 7 moles of ethylene oxide per mole of alcohol.

After the desired formulations with the various coupling agents and surfactant combinations were prepared, their performance was tested with respect to cleaning efficiency (filming and streaking) and stability (appearance at 5° C., 20° C. and 60° C.), as follows.

Filming and Streaking

To test the residue left by the cleaning formulation, filming and streaking tests were done on glass tiles. Ten drops in a circular pattern were applied to a glass tile and wiped with a folded piece of clean cheese cloth with five passes. No downward pressure was applied on the tile, only pressure to create a back and forth motion. The tiles were left to dry for 30 minutes. The tiles were rated on a scale of 1-10 for both filming and streaking compared to standards where WINDEX®: Filming=1 Streaking=1 and FANTASTIK®: Filming=10 Streaking=10. All tiles were rated by the same operator to minimize discrepancies in rating and to eliminate operator to operator differences.

Hard Surface Cleaning: Spring Compression Device (SCiD)

Hard surface cleaning power of the formulations was tested by the removal of soil from a vinyl tile. Vinyl tiles were cut to match the sample size of 11.5 cm×7.5 cm and 500 μL of 3% Carbon Black Brazil soil was applied to the grooved side of the tile using a foam applicator. The tiles were set to dry for approximately 24 hours, and then the tile was placed in the SCiD plate and set on the orbital shaker. 400 μL of the cleaning solutions were dispensed into each well along with one carpeted scrubbie, and the samples were run on the shaker for five minutes. For each sample, 3 wells were tested, and the samples were run side by side with a good and bad cleaning standard. The samples were scanned into the computer and analyzed by the ImageJ software. The cleaning power was measured by the average gray value of the well, and the cleaning power of the sample was measured by the average of the gray value of the three wells. A higher gray value corresponds to a lighter circle and a higher cleaning power, while a lower gray value corresponds to a darker circle and a lower cleaning power.

The following TABLE 2 presents the results of testing various formulations containing different coupling agents and surfactant combinations, using the aforesaid testing procedure. It is noted that values for filming and streaking each run from 1 to 10, with the lowest numbers representing the least filming or streaking and, therefore, being the preferred values. For the "average grey" performance characteristic, the higher values are considered more preferable.

TABLE 2

| | Solvent/Couple-(%) | | | | "Green" Surfactants | | | Other Surfactants |
|---|---|---|---|---|---|---|---|---|
| | DPnP | PGDL | EGDL | 1,3-PDGL | ECOSURF EH-6 | ECOSURF EH-9 | TERGITOL 15-S-15 | NEODOL 25-7 |
| A | | 1.00 | | | 0.13 | 0.13 | 0.25 | |
| B | | 1.00 | | | 0.25 | 0.25 | 0.50 | |
| C | | 1.00 | | | 0.17 | 0.17 | 0.17 | |
| D | | 1.00 | | | 0.33 | 0.33 | 0.33 | |
| E | | 1.00 | | | | | | 0.50 |
| F | | 1.00 | | | | | | 1.00 |
| G | | 1.00 | | | | | | |
| H | | 1.00 | | | | | | |
| I | | | 1.00 | | 0.13 | 0.13 | 0.25 | |
| J | | | 1.00 | | 0.25 | 0.25 | 0.50 | |
| K | | | 1.00 | | 0.17 | 0.17 | 0.17 | |
| L | | | 1.00 | | 0.33 | 0.33 | 0.33 | |
| M | | | 1.00 | | | | | 0.50 |
| N | | | 1.00 | | | | | 1.00 |
| O | | | 1.00 | | | | | |
| P | | | 1.00 | | | | | |
| Q | | | | 1.00 | 0.13 | 0.13 | 0.25 | |
| R | | | | 1.00 | 0.25 | 0.25 | 0.50 | |
| S | | | | 1.00 | 0.17 | 0.17 | 0.17 | |
| T | | | | 1.00 | 0.33 | 0.33 | 0.33 | |
| U | | | | 1.00 | | | | 0.50 |
| V | | | | 1.00 | | | | 1.00 |
| W | | | | 1.00 | | | | |
| X | | | | 1.00 | | | | |
| Y | 1.00 | | | | 0.13 | 0.13 | 0.25 | |
| Z | 1.00 | | | | 0.25 | 0.25 | 0.50 | |
| AA | 1.00 | | | | 0.17 | 0.17 | 0.17 | |
| BB | 1.00 | | | | 0.33 | 0.33 | 0.33 | |
| CC | 1.00 | | | | | | | 0.50 |
| DD | 1.00 | | | | | | | 1.00 |
| EE | 1.00 | | | | | | | |
| FF | 1.00 | | | | | | | |

| | Other Surfactants | | Cleaning Perf. | | | | |
|---|---|---|---|---|---|---|---|
| | NEODOL 45-7 | Water (%) | Filming (1-10) | Streaking (1-10) | Stability* 60° C. | Stability* 5° C. | AVG Grey Values |
| A | | 97.3 | 3 | 2 | Clear | Clear | 69.66 |
| B | | 96.8 | 4 | 4 | Clear | Clear | 93.52 |
| C | | 97.3 | 4 | 4 | Clear | Clear | 82.96 |
| D | | 96.8 | 5 | 5 | Clear | Clear | 94.82 |
| E | | 97.3 | 5 | 6 | Cloudy | Cloudy | 83.67 |
| F | | 96.8 | 3 | 2 | Cloudy | Cloudy | 91.09 |
| G | 0.50 | 97.3 | 4 | 3 | Cloudy | Cloudy | 73.13 |
| H | 1.00 | 96.8 | 5 | 5 | Cloudy | Cloudy | 85.96 |
| I | | 97.3 | 4 | 5 | Clear | Clear | 99.50 |

TABLE 2-continued

| | | | | | | | |
|---|---|---|---|---|---|---|---|
| J | | 96.8 | 6 | 6 | Clear | Clear | 126.84 |
| K | | 97.3 | 5 | 5 | Clear | Clear | 114.50 |
| L | | 96.8 | 6 | 6 | Clear | Clear | 164.02 |
| M | | 97.3 | 5 | 6 | Cloudy | Cloudy | 86.77 |
| N | | 96.8 | 5 | 5 | Cloudy | Cloudy | 115.17 |
| O | 0.50 | 97.3 | 5 | 6 | Cloudy | Cloudy | 61.33 |
| P | 1.00 | 96.8 | 6 | 6 | Cloudy | Cloudy | 63.716 |
| Q | | 97.3 | 5 | 5 | Clear | Clear | 79.37 |
| R | | 96.8 | 7 | 7 | Clear | Clear | 97.50 |
| S | | 97.3 | 5 | 5 | Clear | Clear | 84.14 |
| T | | 96.8 | 6 | 6 | Clear | Clear | 119.47 |
| U | | 97.3 | 6 | 6 | Cloudy | Cloudy | 84.88 |
| V | | 96.8 | 7 | 7 | Cloudy | Cloudy | 129.51 |
| W | 0.50 | 97.3 | 7 | 7 | Cloudy | Cloudy | 60.44 |
| X | 1.00 | 96.8 | 8 | 8 | Cloudy | Cloudy | 92.77 |
| Y | | 97.3 | 3 | 4 | Clear | Clear | 104.54 |
| Z | | 96.8 | 6 | 5 | Clear | Clear | 121.08 |
| AA | | 97.3 | 4 | 5 | Clear | Clear | 129.60 |
| BB | | 96.8 | 5 | 5 | Clear | Clear | 138.14 |
| CC | | 97.3 | 5 | 5 | Cloudy | Clear | 121.33 |
| DD | | 96.8 | 6 | 5 | Cloudy | Clear | 143.99 |
| EE | 0.50 | 97.3 | 4 | 5 | Cloudy | Cloudy | 97.69 |
| FF | 1.00 | 96.8 | 5 | 5 | Cloudy | Cloudy | 114.68 |

*NOTE:
All formulations remained clear at 20° C.

What is claimed is:

1. A cleaning formulation comprising:

(A) an aqueous solvent comprising water;

(B) an active component comprising an organic solvent; and (C) a coupling agent comprising an alkylene glycol dilevulinate having the general formula, $CH_3C(O)CH_2CH_2C(O)O—R—O(O)CCH_2CH_2C(O)CH_3$, wherein R is a $C_2$-$C_8$ straight chain or branched alkylene moiety, and the two levulinate groups ($CH_3C(O)CH_2CH_2C(O)O—$) may be attached to adjacent, or non-adjacent, carbon atoms of the alkylene moiety.

2. The cleaning formulation according to claim 1, wherein said organic solvent has a solubility of no more than 10%, by weight, in water at 25° C. and atmospheric pressure, based on the total weight of the organic solvent and water in solution.

3. The cleaning formulation according to claim 1, wherein said organic solvent is at least one compound selected from the group consisting of: an aliphatic hydrocarbon, an aromatic hydrocarbon, a chlorinated hydrocarbon, a terpene, lemon oil, pine oil, methyl soyate and d-limonene.

4. The cleaning formulation according to claim 1, wherein R is a $C_2$-$C_3$ alkylene moiety.

5. The cleaning formulation according to claim 4, wherein said alkylene glycol dilevulinate is one or more compounds selected from the group consisting of: ethylene glycol dilevulinate, 1,2-propylene glycol dilevulinate and 1,3-propylene glycol dilevulinate.

6. The cleaning formulation according to claim 1, wherein the aqueous solvent comprising water (A) is present in an amount of from 90% to 98% by weight, the active component comprising an organic solvent (B) is present in an amount of from 0.1% to 5.0% by weight, and the coupling agent comprising an alkylene glycol dilevulinate (C) is present in an amount of from 0.1% to 6.0%, all weight percentages based on the total weight of the cleaning formulation.

7. The cleaning formulation according to claim 6, wherein the aqueous solvent comprising water (A) is present in an amount of from 94% to 98% by weight.

8. The cleaning formulation according to claim 6, wherein the active component comprising an organic solvent (B) is present in an amount of from 0.5% to 3.0% by weight.

9. The cleaning formulation according to claim 6, wherein the coupling agent comprising an alkylene glycol dilevulinate (C) is present in an amount of from 0.5% to 3.0% by weight.

10. The cleaning formulation according to claim 1, further comprising one or more of the following additional components:

(D) surfactants;

(E) chelating agents;

(F) buffers/pH adjusters;

(G) biocides;

(H) fragrances;

(I) viscosity modifiers;

(J) colorants; and (K) polymers.

* * * * *